US005503052A

United States Patent [19]

Rigney et al.

[11] Patent Number: 5,503,052

[45] Date of Patent: Apr. 2, 1996

[54] HOLE PUNCH

[76] Inventors: Douglas Rigney, 789 Charlton Dr., Pleasant Hill, Calif. 94523; Leonard Hofheins, 936 Detroit Ave. Suite N, Concord, Calif. 94518

[21] Appl. No.: 180,864

[22] Filed: Jan. 13, 1994

[51] Int. Cl.[6] ..... B26D 5/10

[52] U.S. Cl. ..... 83/467.1; 83/167; 83/599; 83/687; 30/363; 402/1

[58] Field of Search ..... 83/599, 605, 606, 83/687, 691, 167, 467.1; 227/27; 412/16; 30/363; 402/1

[56] References Cited

U.S. PATENT DOCUMENTS

| | | | |
|---|---|---|---|
| Re. 18,201 | 9/1931 | Messner . | |
| 401,918 | 4/1889 | Woglom | 30/363 |
| 606,508 | 6/1898 | Boykin . | |
| 1,174,883 | 3/1916 | McLuckie | 83/599 X |
| 1,285,048 | 11/1918 | Cooke . | |
| 1,759,672 | 5/1930 | Tellier . | |
| 1,827,180 | 10/1931 | Williams | 30/363 |
| 2,258,843 | 10/1941 | Brown | 164/119 |
| 2,370,319 | 2/1945 | Lippincott | 164/124 |
| 2,876,714 | 3/1959 | Brown | 107/47 |
| 3,142,216 | 6/1964 | Rupnow | 83/308 |
| 3,172,325 | 3/1965 | Wernham et al. | 83/599 |
| 3,276,355 | 10/1966 | Carter | 30/363 X |
| 3,320,843 | 5/1967 | Schott | 83/620 |
| 3,392,447 | 7/1968 | Hendricks et al. | 30/363 |
| 3,431,591 | 3/1969 | Betso | 16/171 |
| 3,431,592 | 3/1969 | Kovacs | 16/178 |
| 3,772,950 | 11/1973 | Sorensen et al. | 83/143 |
| 4,010,543 | 3/1977 | Nusbaum | 30/316 |
| 4,033,037 | 7/1977 | Cooley | 30/363 |
| 4,240,572 | 12/1980 | Mitsuhashi | 227/76 |
| 4,491,261 | 1/1985 | Mitsuhashi | 227/76 |
| 4,869,143 | 9/1989 | Merrick et al. | 83/467.1 |
| 4,987,683 | 1/1991 | Brych | 30/363 |
| 5,291,813 | 3/1994 | Blumenthal et al. | 83/599 |

FOREIGN PATENT DOCUMENTS

| | | | |
|---|---|---|---|
| 36031 | 2/1967 | Finland | 402/1 |

*Primary Examiner*—Rinaldi I. Rada
*Attorney, Agent, or Firm*—Thomas R. Lampe

[57] ABSTRACT

A compact and portable hole punch for manually punching holes through sheet-like material to produce hole sets which enable the material to be mounted on multi-ring binders. The hole punch includes male and female plates which are pivotally mounted together. The male plate carries a plurality of punch pegs while the female plate carries die openings through which the punch pegs penetrate to cut the openings in the material when the plates are pressed together. The female plate is formed with extension portions which provide surfaces permitting the user to releasably hold the material during the punching operation. A receptacle is removably mounted on the female plate for catching waste material from the die openings, and an adjustable stop guide is mounted on the receptacle or directly into the female plate. Fingers are provided on the male plate for yieldably urging the plates to a neutral position, for releasably holding sheet-like material during the cutting operation, and for pushing the material free of the punch pegs after the cutting operation.

25 Claims, 8 Drawing Sheets

HOLE PUNCH

BACKGROUND OF THE INVENTION

1. Field of the Invention

This invention relates in general to devices for punching holes through business cards, paper or other sheet-like material to be mounted on multi-ring binders.

2. Description of the Prior Art

Multi-ring binders are commonly employed for mounting loose leaf card or paper sheets. The binders are provided with closable rings mounted on a spine with front and back covers which can be closed to protect the mounted sheets. Among the binder designs which are commercially available are those in which three or more rings are mounted at spaced positions along the spine. The number of rings and their spacing is varied in accordance with the dimensions of the paper or other requirements. Particularly for larger size material a larger number of rings are provided. Certain of the binder designs provide sets of rings which are equally spaced apart with longer spacing between the ring sets. Typically replacement sheets with mounting holes pre-punched in accordance with the spacing of the hole sets are sold for use with these binders.

Hole punches are commonly available so that blank paper sheets can be punched by the user for mounting in binders, but this requires that the hole sets of the punches correspond with the number of rings and ring spacing of the particular binder. Three-ring paper punches are commonly available, and in many of these punches the spacing between the punch pegs can be adjusted by the user for matching different ring binders. However, these types of punches are relatively large and bulky such that they are not mobile, and they do not lend themselves to be stored in small spaces such as in a user's desk drawer or briefcase.

Business cards are widely used by professionals and other workers when making contacts at business meetings or on trips. Typically people receiving business cards either transfer information from the cards onto their computer or other media at their office, or attempt to organize the cards by filing them according to different categories of information. A conventional system for organizing the cards is with a plastic jacket in which the cards are placed. The plastic jacket method is inconvenient from the standpoint that it requires that the cards be rearranged to make space for a new card, and this is a time consuming process. The prior art hole punchers are not readily adaptable for punching standard business cards for filing in a multi-ring binder.

The need has been recognized for a hole punch which obviates the foregoing and other limitations and disadvantages of prior art hole punches. Despite the various types of hole punches in the prior art, there has not yet been provided a suitable and attractive solution to these problems.

SUMMARY OF THE INVENTION

The present invention provides a hole punch for manually punching holes through business cards or other sheet-like material for mounting on multi-ring binders. The punch is comprised of a male plate which carries a plurality of punch pegs and a female plate which is formed with a plurality of die openings. The plates are mounted together for pivotal movement for inserting the punch pegs into respective die openings to punch holes in the material. In one embodiment groups of the punch pegs and die openings are provided on opposite sides of the joint which pivotally mounts the plates together so that movement of the pegs into the die openings on one side simultaneously withdraws the pegs on the opposite side from their corresponding die openings. In another embodiment a removably mounted receptacle is provided for catching chaff material which is cut by the punch pegs. In another embodiment the female plate is provided with an extension portion which provides a gripping surface for the user to hold the sheet-like material during and/or after the punching operation. In still another embodiment an adjustable guide provides a stop surface for the edge of the card for selective placement of the hole sets to be cut by the punch pegs.

The foregoing and additional objects and features of the invention will appear from the following specification in which the several embodiments have been set forth in detail in conjunction with the accompanying drawings.

DESCRIPTION OF THE PREFERRED EMBODIMENTS

Figure 1:
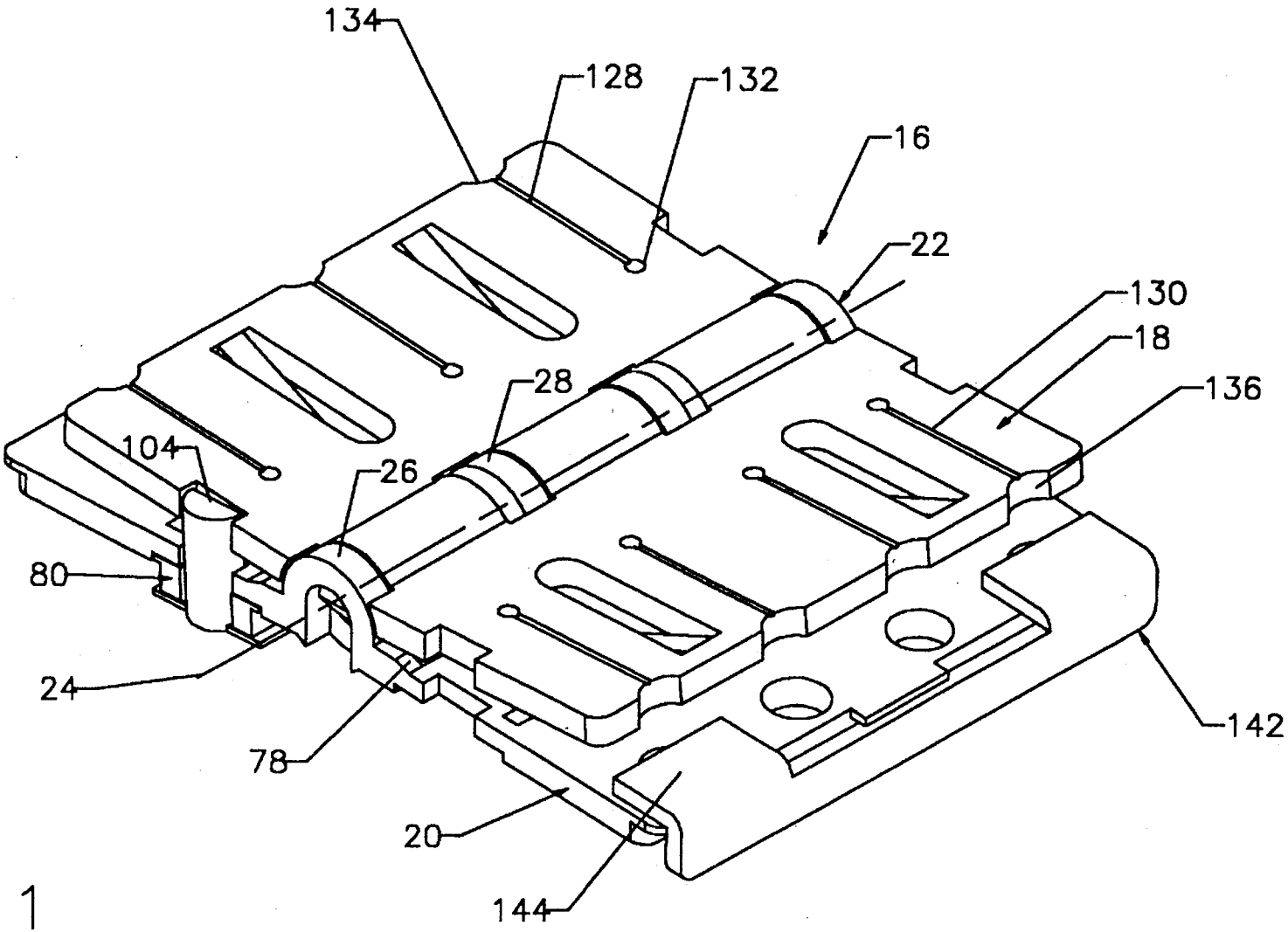
FIG. 1 is a perspective view of a hole punch incorporating one embodiment of the invention.

In the drawings FIG. 1 illustrates generally at 16 a preferred embodiment of the invention providing a hole punch for use in manually punching holes through business cards, paper or other sheet-like material to be mounted on multi-ring binders. The hole punch is operated by the user to punch hole sets which are sized and oriented to correspond with the rings of different types of commercially available loose leaf binders.

Figure 2:
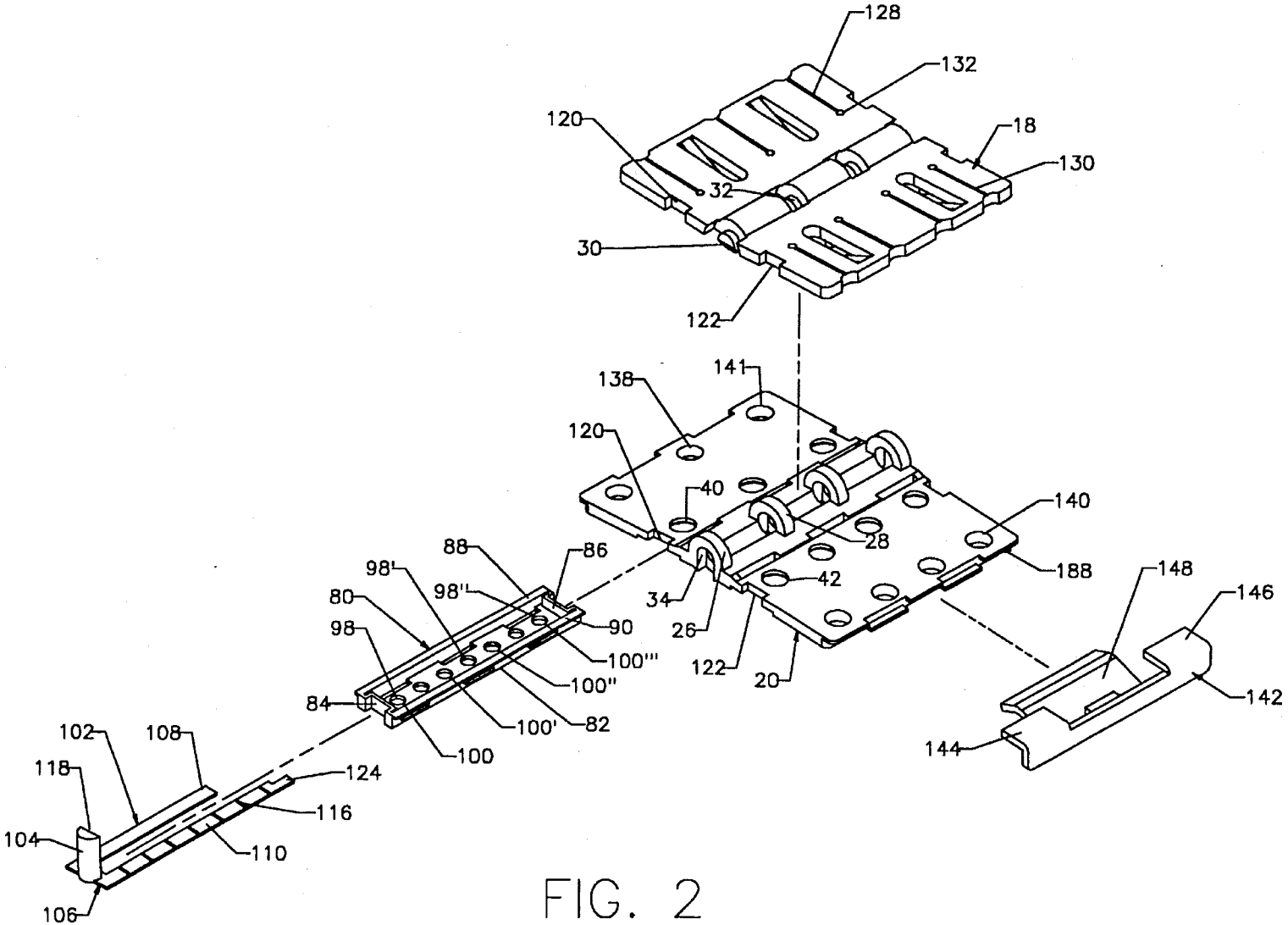
FIG. 2 is an exploded perspective view, to a reduced scale, of the hole punch of FIG. 1.

Hole punch 16 is comprised of male plate 18 and female plate 20 which are mounted together by means of a hinge 22 for back and forth movement about a transverse pivot axis 24. The hinge comprises a plurality, shown as four, of semi-circular knuckles 26, 28 formed on the top side of the female plate and a corresponding number of pivot pins 30, 32 formed on the male plate. As best shown in FIG. 2, the knuckles are formed with journals 34 into which respective pivot pins rotatably fit.

The male and female plates are molded of a suitable synthetic plastics material having sufficient elasticity which permits the pivot pins and knuckles to snap together so that after the plates are assembled they are substantially permanently joined. Alternatively, the plates could be mounted together with suitable means which permit separation, such as for performing maintenance.

Male plate 18 carries a plurality of punch pegs 36, 38 while the female plate is formed with a plurality of die openings 40, 42 which are sized and positioned in corresponding relationship with respective ones of the punch pegs. The illustrated embodiment provides a seven-hole punch with a set of three punch pegs 36 and corresponding die openings 40 on one side of the hinge and a set of four punch pegs 38 and corresponding die openings 42 on the opposite side.

The diameters of the punch pegs and die openings are commensurate with the outer diameters of the rings for the particular binders for which the hole punch is to be used. Typical diameters for the punch pegs are 3/16" or ¼". The set of three punch pegs 36 and corresponding die openings on one side of the hinge are formed with a pitch, i.e. center-to-center spacing, of ¾" while the set of four punch pegs 38 and corresponding die openings on the opposite side have a pitch of ½". This combination permits the hole punch to be used with a large variety of commercially available binders. The invention contemplates that other combinations of number of hole sets and pitch dimensions could be provided to accommodate the requirements of specific ring binder designs. For example, a set of three punch pegs and die openings could be provided on one side of the hinge and a set of two could be provided on the other side. Another arrangement contemplated by the invention is to provide the set of punch pegs and die openings on only one side of the hinge.

Figure 5:
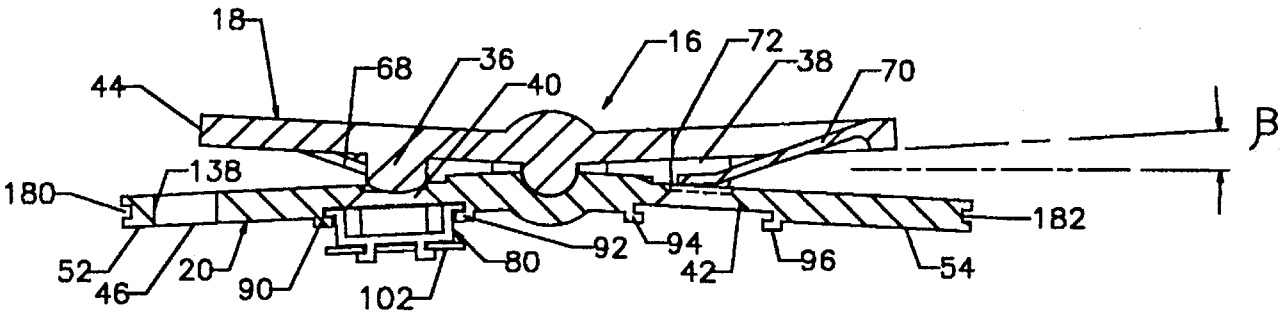
FIG. 5 is a longitudinal cross-sectional view of the assembled male and female plates, waste catcher and guide stop shown in FIG. 2.
Figure 6:
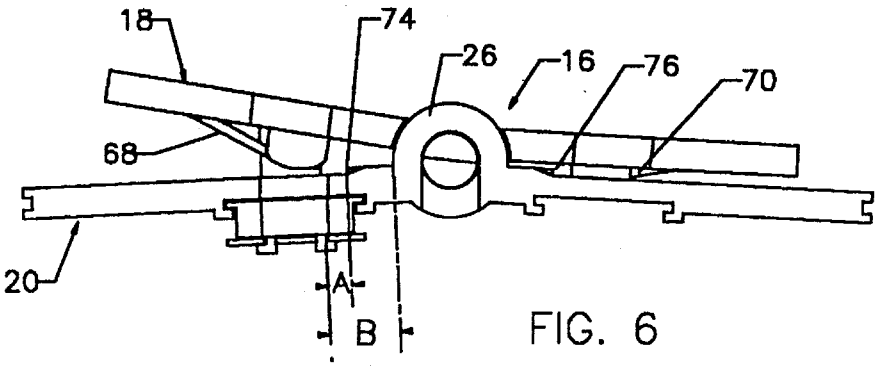
FIG. 6 is a side view of the assembly shown in FIG. 5 with the components in a moved position.
Figure 7:
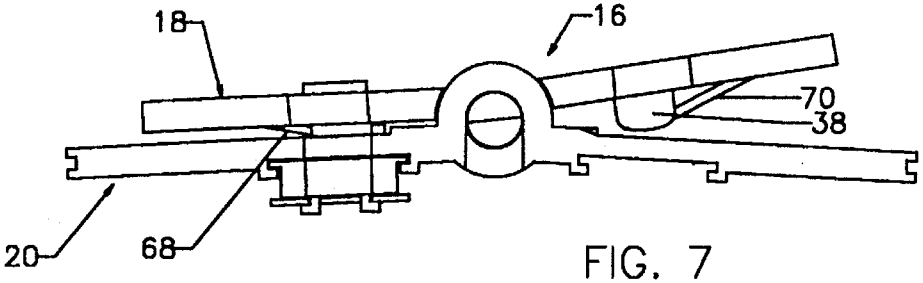
FIG. 7 is a side view similar to FIG. 6 with the components shown in another moved position.

As best illustrated in FIGS. 5–7 the male and female plates are each formed with side portions or wings 44, 46 which diverge outwardly from the hinge. The wings on each side are formed so that they incline at an angle $\beta$ in the range of 1.5° to 4.5° and preferably 3° from a plane which is normal to a longitudinal plane extending through the axial center line of the hole punch when the male and female plates are in their neutral positions of FIG. 5. The combined included angles between the male and female plates on each side is thus in the range of 3° to 9° and preferably 6°. This facilitates a "butterfly" operation by which a person, using his or her fingers, can grip and pinch together the plates on one side to cause the pegs to be inserted into their respective die openings while simultaneously causing the plates on the opposite side to spread apart for withdrawing the pegs on that side from their respective openings.

Figure 8:
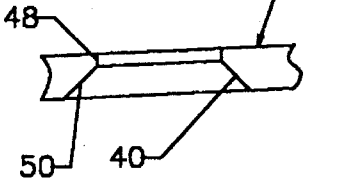
FIG. 8 is a fragmentary view, to an enlarged scale, of a portion of the female plate of FIG. 5 showing details of one die opening.

FIG. 8 illustrates details of one typical die opening 40 on the female plate. On the entrance side of the die opening a straight hole 48 is formed with a diameter commensurate with that of the corresponding punch peg. On the exit side the hole 50 is chamfered with outwardly diverging side walls to facilitate entry of the punch peg and for ease of discharging paper waste or chaff.

As best illustrated in FIGS. 5–7 the female plate 20 is formed on each side with extension portions 52, 54 which project beyond respective sides of the male plate. With the card or other sheet-like material in place for punching, these extension provide areas for the user to grip the card or other material against the female plate so that the material can be stabilized to ensure that the holes are accurately punched. The extension portions also increase the leverage that the person can apply for operating the punch, and this facilitates punching through thick materials such as stiff card stock.

Figure 3:
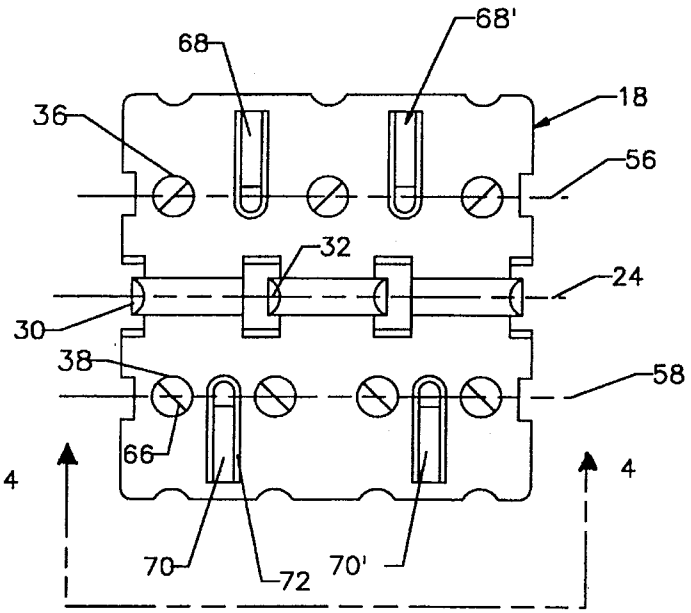
FIG. 3 is a bottom plan view of the male plate shown in FIG. 2.

The bottom plan view of the male plate of FIG. 3 shows that the opposite sets of punch pegs 36 and 38 are aligned along respective cutting axes 56 and 58 which are parallel with the pivot axis formed by the hinge. The punch pegs are each formed at the distal ends with crowns, as shown by the crown 60 for peg 38 in FIG. 4. The crowns are molded with opposed cutting edges 62, 64 which are separated by a V-shaped notch which diverges outwardly from a line 66 which extends across the diameter of the peg. The cutting edges are contoured with convex peaks which are oriented at a bias or diagonal angle, preferably 45°, to the cutting axis.

During the punching operation each punch peg begins its insertion into the entrance side of the die opening at an angle from the centerline of the opening, as illustrated by the showing of the neutral position in FIG. 5. This offset angle decreases until the punch peg is substantially aligned with the centerline of the die opening when it is at the fully inserted positions as shown by the punch peg on the right hand side of FIG. 5. In the invention with the punch peg crowns oriented so that their cutting edge peaks are at a bias to the cutting axis, the portion of the crown which first enters the opening is at a point away from the edge of the opening closest to the hinge. This provides for a clean cut of material around the border edge of the hole as the peg enters the die opening.

Figure 4:
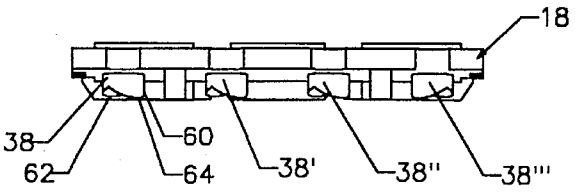
FIG. 4 is an end view of the male plate taken along the line 4—4 of FIG. 3.

On each set of punch pegs at least two of the pegs are of different lengths so that the longer pegs begin their cutting action shortly before that of the shorter pegs. This is shown in FIG. 4 where the center pair of pegs 38' and 38" are shorter in length than the outboard pair of pegs 38 and 38'''.

Means is provided for applying yieldable forces against the business cards or other sheet-like material both for releasably holding the material in place for the cutting operation and for pushing the material away from the punch pegs as they are withdrawn from the die openings. This means comprises a plurality of fingers 68, 70 which are carried by the male plate, with the fingers having distal end portions which extend toward the female plate. On the side of the male plate having the set of three punch pegs 36, a pair of fingers 68 and 68' are provided straddling the center peg. On the opposite side of the male plate another pair of fingers 70 and 70' is provided with each finger spaced between an outboard pair of pegs. The proximal end of each finger is molded integrally with the outer margin of the male plate, and the finger inclines downwardly and inwardly through an elongate cavity 72. The cavity 72 is sized and shaped so that the distal end of the finger is free to be pushed up into the cavity by the upper surface of the female plate, when the male and female plates are pressed together to their closed positions, for example on the left side shown in FIG. 7. On the opposite side of FIG. 7 the male and female plates are moved to their open position where the crowns of the punch pegs provide sufficient clearance for insertion of the edge of the card or other sheet-like material. As the material is inserted in the gap between the pegs and upper surface of the female plate, the corresponding fingers on that side, because of their elastic memory, apply yieldable forces downwardly against the material to hold it in its ready position. This minimizes slippage of the material from the desired orientation to ensure hole cutting accuracy. After the hole is cut the plates are again moved to their open position, and the fingers continue to apply the yieldable force to move or eject the material downwardly and away from the pegs. This releases the hole that has been punched so that it is easier to withdraw the material from the hole punch.

A further function of the fingers is for normally urging the male and female plates to the neutral position shown in FIG. 5 when no force is being applied by the user. Because the number of fingers on each side of the hinge is the same, the force of the fingers on the two sides is equal so that opposite sides of the male and female plates are maintained at substantially the 6° included angle at the neutral position. In the neutral position the distal ends of the punch pegs are just at the entrances of the die openings so that the punch pegs in this position serve to keep out unwanted and potentially harmful objects. This serves to protect the punch pegs, and particularly the sharpened edges of the crowns, from damage in that the crown edges are partially within the die openings. A still further function of the fingers is to hold paper or other flimsy sheet-like material taut over the die openings, thereby reducing any tendency of the material from caving into the openings.

As the opposite sides of the male and female plates are pivoted back and forth between their open and closed positions, the co-action of the set of punch pegs on one side as they begin to emerge from the corresponding die openings acts as a guide to stabilize the set of punch pegs on the opposite side so that they are properly aligned to begin insertion into their corresponding die openings.

Female plate 20 is formed on each side of the hinge with edge stop means for releasably stopping movement of the border edges of business cards or other material to selected inner and outer stop positions. The outer stop positions are defined by a pair of ridges 74, 76 which extend upwardly from the female plate at a predetermined distance inwardly from the edge of the die opening, shown as dimension A in FIG. 6. With the dimension A=1/16", the ridges stop the edges of heavier sheet-like material, such as card stock, at positions where the holes are punched to leave a 1/16" margin at the edge of the sheet. The inner stop positions are defined by the outer surfaces of knuckles 26 on the female plate. The knuckle surfaces are spaced at a distance B from the inner edge of the die openings, and preferably the dimension B=5/32". For flimsy sheet-like material such as paper, the knuckles provide a stop for the paper edge at a position where the holes that are cut leave a 5/32" margin. At opposite sides of the ridges bevel surfaces 78 (FIG. 1) incline upwardly from the female plate. These bevel surfaces permit the user to more easily slide the edge of the paper or other material up and past the outer ridges to the inner stop of the knuckles when it is desired to provide a wider margin or border setting for the punching operation.

Figure 9:
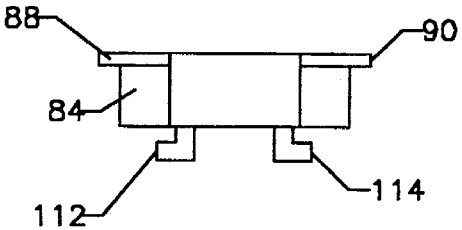
FIG. 9 is an end view, to an enlarged scale, of the waste catcher shown in FIG. 5.

A waste catcher 80 is provided for catching and temporarily storing waste material or chaff that is cut by the punch pegs. The waste catcher is comprised of an elongate U-shaped enclosure wall 82 having opposite end walls 84, 86, as best shown in FIG. 2. Outwardly projecting elongate ribs 88, 90 (FIG. 9) are formed along the opposite upper sides of the enclosure wall. These ribs are sized and shaped commensurate with pairs of elongate laterally spaced-apart rails 90, 92 and 94, 96 which are molded integrally on the lower sides of the female plate. The two pairs of rails are adapted to mount the receptacle along the length of the sets of die openings on either side of the hinge. A plurality of circular apertures 98, 100 are formed in the bottom of the enclosure wall, as best illustrated in FIG. 2. The diameters of these apertures are less than that of the die openings so that the chaff does not fall out of the receptacle. Preferably the number of apertures in the receptacle is equal to the combined number of the die openings on both sides, and the apertures are spaced so that with the receptacle mounted on either side, all of the die openings on either side can be viewed directly through a corresponding set of apertures. In the illustrated embodiment, seven apertures are provided in the receptacle, with the three apertures 98, 98' and 98" being oriented so that they are in alignment with the set of three die openings 40 when the receptacle is mounted below that set. The remaining four apertures 100, 100' 100" and 100'" are oriented so that they are in alignment with the set of four openings 42 when the receptacle is mounted on the opposite side. When these apertures are in alignment with their respective die openings, the user can visually sight through the apertures, prior to the punching operation, to determine if any printed or written indicia on the card or paper is in view. If any such printed or written matter is in view, and the user does not desire to have it punched through, then the paper or card can be repositioned.

A slide guide 102 is mounted on the bottom of the waste catcher for providing an adjustable stop for the edge of the card or other sheet-like material. The slide guide could alternatively be mounted directly onto the rails 90, 92 or 94, 96 of the female plate in place of the waste catcher. The slide guide is comprised of a half-round tip 104 which projects at right angles from the end of a U-shaped slide 106 having bifurcated arms 108, 110. The slide arms are adapted to slidably fit along the outside of a pair of elongate rails 112, 114 which are molded integrally below the enclosure wall of the receptacle. Gradation marks 116 are formed along the surfaces of one or both of the slide arms to assist the user in sliding the guide stop to a predetermined position relative to the receptacle so that the edge of the sheet-like material is at the desired position for the hole cutting operation. Flat side 118 of the half-round tip provides a straight surface which is orthogonal with the cutting axes so that the hole sets which are punched through the paper are also orthogonal with the paper edge which abuts the tip. In addition, the tip 104 can be used as a peg by inserting it into a previously punched hole to thereby act as a guide for punching an additional set of holes towards the middle of a large piece of paper material.

Square-shaped cutouts 120, 122 are formed at the opposite ends of the male and female plates on either side from the hinge. These cutouts cooperate with the half-round tip of the slide guide for purposes of selectively holding the male and female plates at the neutral position shown in FIG. 5. The user first pivots the plates to the neutral position and then pushes slide guide 102 inwardly until half-round tip 104 is inserted into and releasably fits with the pair of aligned notches that are on the same side to which the waste receptacle and/or slide guide are mounted. The action of the half-round tip in locking the plates in their neutral position provides an additional safety feature and minimizes the chance of unwanted objects being inserted between the plates to damage the cutting edges of the punch pegs.

An extension portion 124 is formed on one of the bifurcated arms 110, and the end of this extension is tapered to a size which is adapted for insertion into the apertures 98, 100 at the bottom of the waste receptacle. The user can withdraw the slide guide completely out of the waste receptacle and then use tapered end portion 124 as a poke tool through the apertures to clean out any waste material through the apertures and/or through the die openings in the female plate.

The top surfaces of the male plate are printed or otherwise marked with a series of straight guidelines 128, 130 to assist the person to visually align the hole punch at the desired punching position over the paper or other material. On the side with the set of three punch pegs 36, the three straight lines 128 are formed in alignment with the respective pegs, and on the opposite side the four straight lines 130 are formed in alignment with their respective pegs. At the inner ends of these lines small circular dots 132 are formed directly in alignment with centers of the pegs to provide a further aid for use in visually determining the "dead center" position of the punches. The guidelines and dots permit the user to identify where the holes will be punched and permit any required lateral movement or adjustment of the sheet-like material.

Semi-circular cutouts 134, 136 are formed on the opposite edges of the male plate, and each cutout is aligned with respective guidelines and punch pegs. These cutouts both accommodate the shape of the rings of the binder when the hole punch is stored in the binder, and additionally function as user identification of the hole pattern that will be made on the side at which the cutouts are viewed.

A plurality of storage holes 138, 140 are formed through opposite sides of the female plate for purposes of mounting the hole punch directly onto the rings of a loose leaf binder. When so mounted, the hole punch is stored for convenient and ready access by the user. On the side of the female plate having the set of three die openings, three storage holes 138 are formed in alignment with the die openings. The storage holes have diameters commensurate with the outer diameters of the rings in the binder. On the opposite side of the female plate a series of four storage holes 140 are formed in alignment with the respective die openings on that side.

A storage clip 142 is provided as an alternate method of storing the hole punch with a loose leaf binder. The storage clip is comprised of a pair of outer arms 144, 146 together with an inner arm 148, with the spacing between the inner arm and pair of outer arms commensurate with the thickness of the female plate so that the female plate can slide between the arms. A pair of short pins, not shown, formed integrally on the bottom surfaces of the outer arms are sized and positioned to snap into the outermost storage holes 140 on the four hole side, or alternatively into holes 141 on the three hole side, to releasably hold the storage clip on the female plate. The inner arm is then pushed onto the edge of one of the covers of the binder to releasably hold the clip and thereby the hole punch on the binder for easy access by the user.

Figure 10:
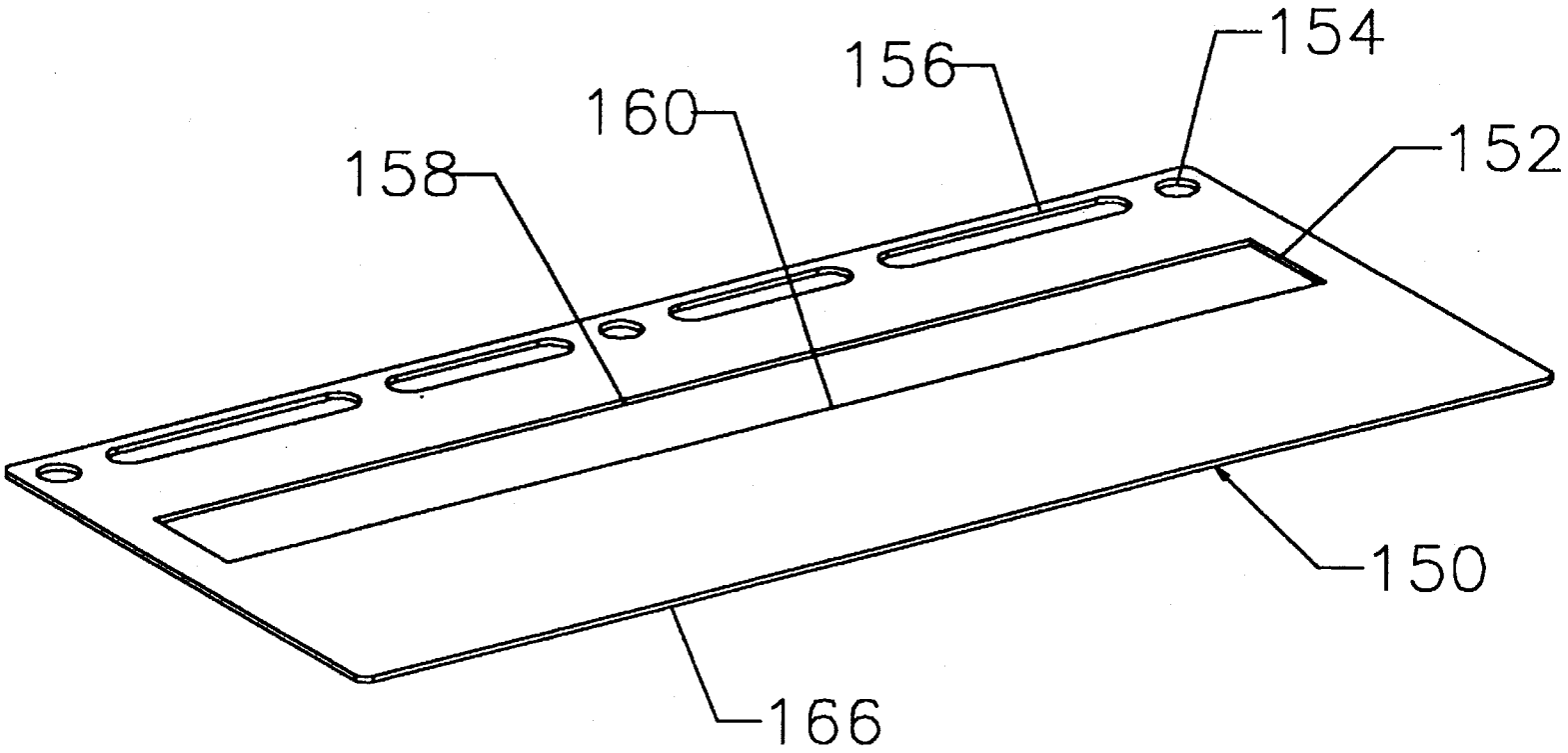
FIG. 10 is a perspective view of a mounting card for use with the hole punch of FIG. 1.
Figure 11:
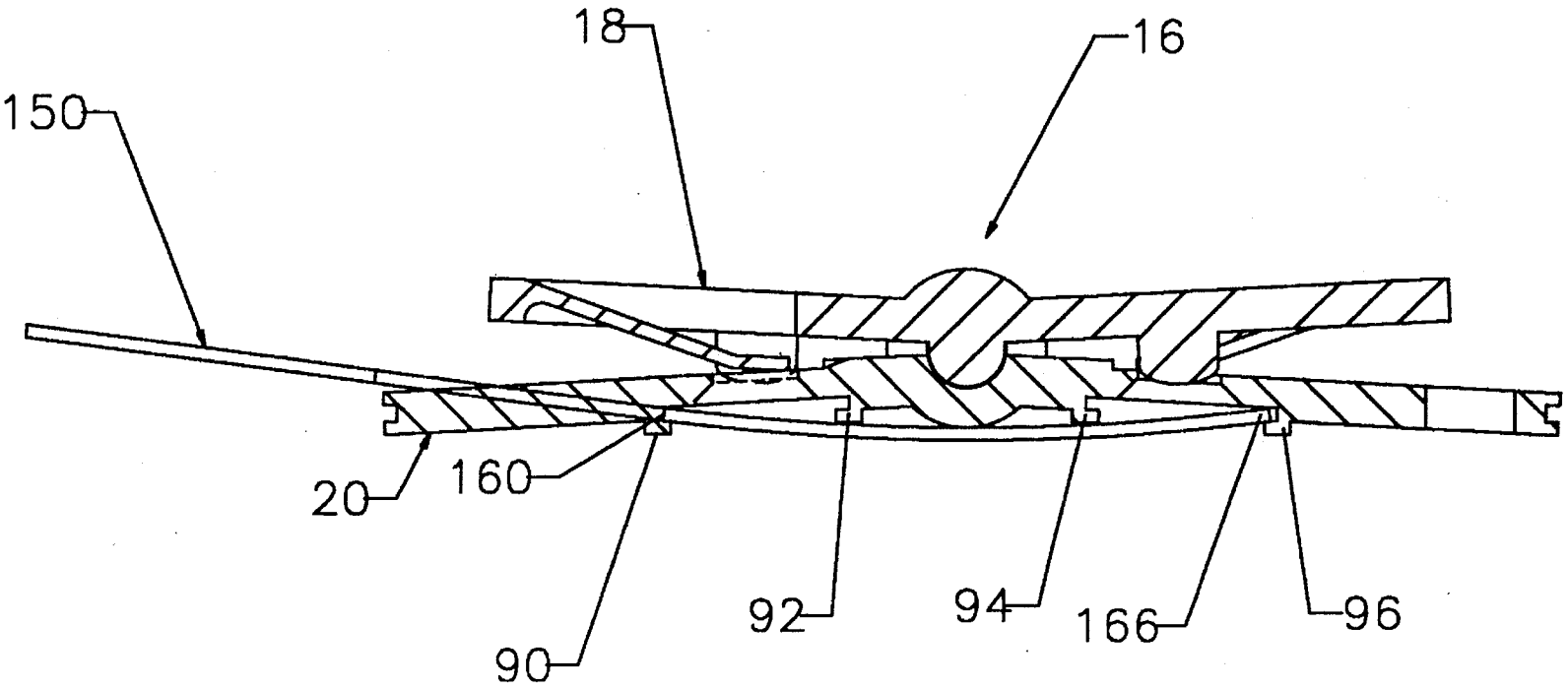
FIG. 11 is a cross-sectional view of the mounting card of FIG. 10 showing the hole punch of FIG. 1 mounted thereon.

FIGS. 10 and 11 illustrate another embodiment providing an alternate means for releasably mounting hole punch 16 within a ring binder. This embodiment provides a card or mounting sheet 150 of flexible stiff material formed with an elongate rectangular aperture 152. A series of apertures 154, 156 are formed on one margin of the sheet for purposes of mounting on the rings of a variety of binder designs. Aperture 152 is formed with side edges 158, 160. Outer side edge 160 is spaced from outer edge 166 of the mounting sheet a distance which is a few percent greater than the distance between outer rail 90 on one side of female plate 20 and outer rail 96 on the opposite side of the plate. The user can insert outer edge 166 of the mounting sheet into the slot formed by female plate rail 96 and then bow the mounting plate slightly until the outer edge 160 of the aperture is fitted within the opposite rail 90, as shown in FIG. 11. This achieves a sliding fit between the mounting card and female plate so that the hole punch can be moved along the length of aperture 152 to the desired position for punching cards or paper mounted in the binder. The bow in the card provides a friction grip for releasably holding the hole punch. The advantage to the embodiment of FIGS. 10 and 11 are that the hole punch can be moved to any desired setting because of the friction caused by the bow, and the card thickness and overall dimensions are relatively small. In addition, the bow in the card itself forms a cavity below the female plate for capturing the waste.

Figure 12:
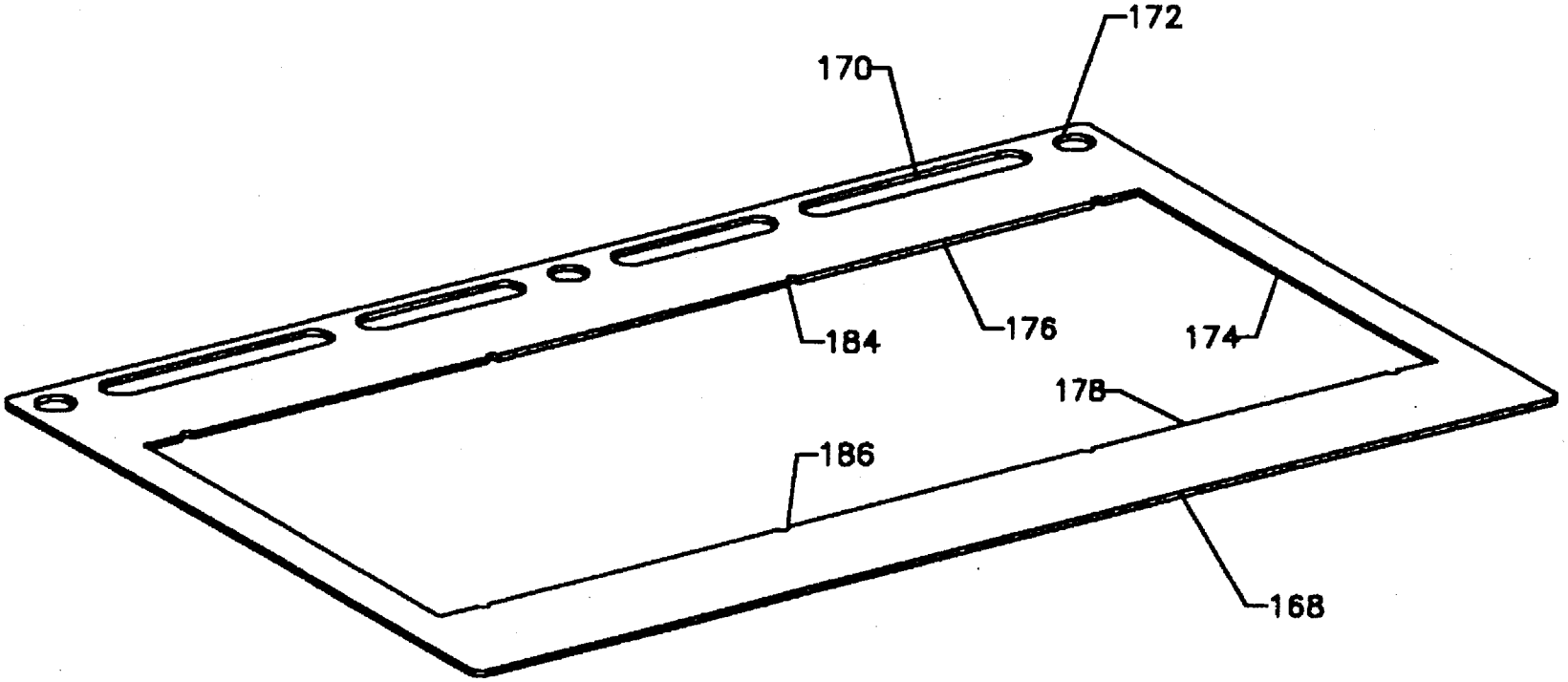
FIG. 12 is a perspective view of a modified form of mounting card for use with the hole punch of FIG. 1.

FIG. 12 illustrates an embodiment of the invention providing a mounting card or sheet 168 for alternatively mounting hole punch 16 on a ring binder in a manner which permits the punch to be operated when so mounted. An advantage to this embodiment over that of FIGS. 10 and 11 is that it allows the use of the waste catcher. Mounting sheet 168 is comprised of a sheet of card stock or other flexible stiff material which is formed at one side margin with a plurality of apertures 170, 172 that are sized and positioned for mounting in the rings of a variety of binder designs. A rectangular aperture 174 is formed in the mounting sheet with the aperture having internal spaced-apart side edges 176, 178 that are parallel with the line of mounting apertures 170, 172. The parallel peripheral side edges of the female plate are formed with support slots 180, 182, as best shown in FIGS. 5–7. The aperture side edges 176, 178 in the mounting sheet are spaced apart commensurate with the spacing between the opposite support slots 180, 182 so that the female plate can be mounted within aperture 174 with the mounting sheet aperture side edges 176, 178 in support slots 180, 182 of the female plate and the hole punch 16 frictionally engaged by and on the mounting sheet. When so mounted the support slots slidably fit with respective side edges of the mounting sheet. A plurality of indents 184, 186, shown as three, are formed on each side edge of the mounting sheet. On opposite corners of the female plate nibs 188 (FIG. 2) are formed of a size commensurate with the indents. The nibs are adapted to releasably seat within the indents as the hole punch is slid along the mounting sheet aperture. The indents are formed at predetermined positions along the side edges so that the hole punch can be moved to and releasably held at the selected positions where the nibs engage the indents. At the selected positions the hole punch can be operated to accurately punch the hole sets into cards or other material held on the ring binder.

Figure 13:
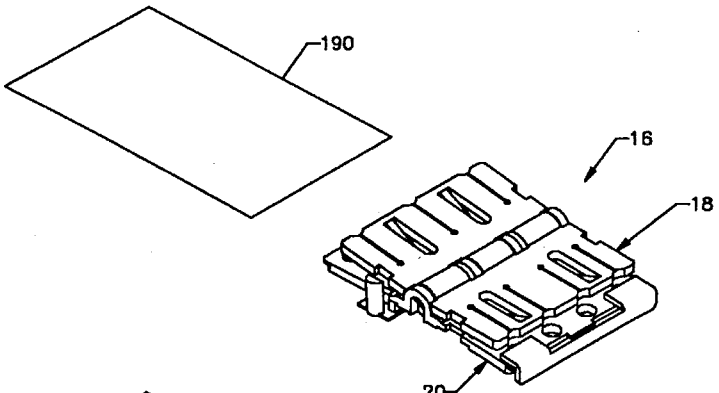
FIG. 13 is a perspective view similar to FIG. 1 showing positions of components of the die punch in an initial step for punching a sheet of material.
Figure 14:
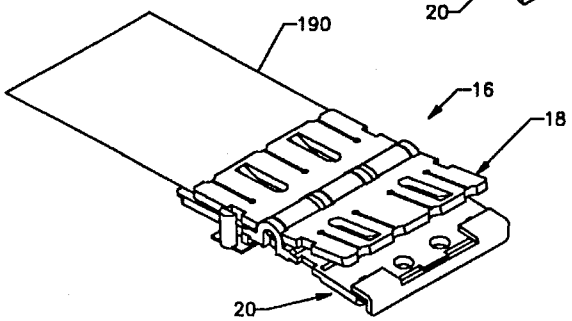
FIG. 14 is a perspective view similar to FIG. 13 showing the components of the die punch during the punching operation.
Figure 15:
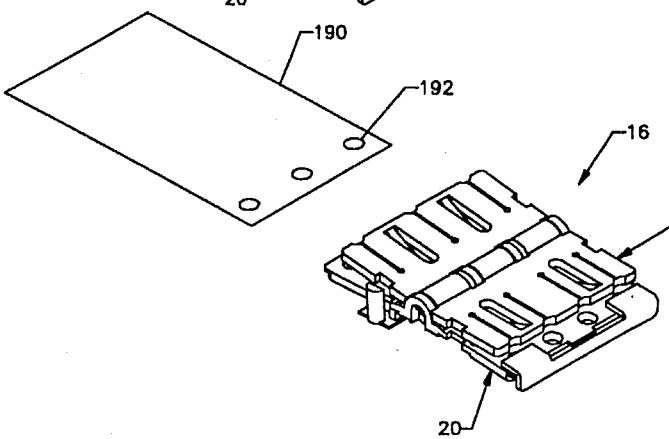
FIG. 15 is a perspective view similar to FIG. 14 showing the components of the die punch following the punching operation.

FIGS. 13–15 illustrate operation of hole punch 16 for punching three holes in the edge of a typical business card 190. In the first step, the user presses the female and male plates together on one side so that the plates on the opposite side are moved apart to their open positions at which the distal ends of the punch pegs are raised above the die openings. The end of card 190 is then inserted between the open plates, and the user presses the male and female plates together on the engaged side so that the pegs punch down through the material of the card and into the die openings to cut the holes 192. The chaff cut by the die openings falls into the chamber of waste receptacle 80. The opposite sides of the plates are again pressed together, and this in turn moves the engaged sides of the plates back to their open position. This permits the card to be withdrawn from between the plates, as shown in FIG. 12.

While the foregoing embodiments are at present considered to be preferred it is understood that numerous variations and modifications may be made therein by those skilled in the art and it is intended to cover in the appended claims all such variations and modifications as fall within the true spirit and scope of the invention.

What is claimed is:

1. A hole punch for use by a person to manually punch holes through sheet-like material to produce hole sets which are appropriately sized and oriented to enable the sheet-like material to be mounted on a multi-ring binder, the hole punch comprising the combination of a male plate having opposing side portions, a female plate having a plurality of die openings, and peg means carried on said opposing side portions of the male plate, said peg means being insertable into respective die openings for punching holes in sheet-like material which is at a ready position between the peg means and die openings, said male plate and said female plate being pivotally interconnected for movement of one side portion of the male plate toward the female plate due to manual manipulations while moving an other side portion opposing said one side portion away from the female plate, said movement of the one side portion toward the female plate causing said insertion of the peg means into said die openings, and said movement of the other side portion away from the female plate causing said peg means to withdraw from said die openings to enable the sheet-like material to be moved between or withdrawn from said ready position.

2. A hole punch as in claim 1 including at least one extension portion on said female plate projecting in a direction from said pivot axis beyond the male plate to enable a person to releasably hold the sheet-like material against the extension portion during operation of the hole punch.

3. A hole punch as in claim 1 including a pair of extension portions on said female plate which project in directions beyond respective side portions of the male plate to enable a person to releasably hold the sheet-like material against the extension portions during operation of the hole punch.

4. A hole punch as in claim 1 in which said peg means comprises a plurality of punch pegs, and at least two of said punch pegs have distal ends which project at different lengths from the male plate to minimize the amount of force required to cause the punch pegs to punch holes through the sheet-like material.

5. A hole punch as in claim 1 in which said peg means comprises a plurality of punch pegs having distal ends aligned along at least one cutting axis which overlies the die openings when said one side portion of the male plate is moved toward the female plate, and said male plate pivotal relative to the female plate about an axis which extends substantially parallel with said cutting axis of the punch pegs and at least certain ones of said punch pegs having crowns at their distal ends with each crown having a pair of diametrically opposed cutting edges that face toward and shear along said die openings during said insertion of the punch pegs into the die openings, the cutting edges being contoured with convex peaks which are oriented at a bias to said cutting axis for minimizing the amount of force required to cause the punch pegs to punch holes through the sheet-like material.

6. A hole punch as in claim 1 which includes yieldable means for applying a yieldable force against the sheet-like material in a direction to releasably hold the material in place against the die openings when the material is in said ready position.

7. A hole punch as in claim 6 in which said yieldable means comprises at least one elongate finger carried by the male plate and having a distal end portion which extends toward and into contact with the sheet-like material when the material is in said ready position.

8. A hole punch as in claim 7 in which said finger is formed of an elastic material.

9. A hole punch as in claim 1 which includes yieldable means for applying a yieldable force against the sheet-like material in a direction to move the material away from the peg means after said withdrawal of the peg means from the die openings.

10. A hole punch as in claim 1 in which said male plate is moveable relative to the female plate from a neutral position, at which the side portions are spaced substantially equally from the female plate, to a first operating position at which one side portion is adjacent the female plate for insertion of the peg means into said die openings while an other side portion is spaced at an extended distance from the female plate, and said male plate is further moveable to a second operating position at which other side portion is adjacent the female plate for insertion of the peg means into said die openings while said one side portion is spaced at an extended distance from the female plate, and yieldable means for yieldably urging said male plate to said neutral position from said first and second operating positions.

11. A hole punch as in claim 10 in which said yieldable means comprises at least one elongate finger carried by the male plate and having a distal end portion which extends toward and for contact with said female plate.

12. A hole punch as in claim 11 in which said finger is formed of an elastic material.

13. A hole punch as in claim 1 in which said opposing side portions of the male plate diverge outwardly at angles from respective adjacent portions of the female plate when the male and female plates are moved to a neutral position at which said side portions are substantially equally spaced from the female plate.

14. A hole punch as in claim 13 in which said angles are in the range of substantially 1.5 to 4.5 degrees.

15. A hole punch as in claim 1 in combination with a mounting sheet adapted for mounting on a binder, said mounting sheet having internal spaced-apart parallel side edges defining an aperture, means for providing parallel peripheral side edges on either of said male or female plates with the side edges being spaced apart commensurate with said aperture, and means for providing support slots which extend along said peripheral side edges for slidable engagement with the side edges of the mounting sheet to enable movement of the hole punch to a range of positions at which the hole sets can be punched through the sheet-like material.

16. A hole punch as in claim 1 for use with sheet-like material which has straight side edges, said hole punch including edge stop means on said female plate for releasably stopping movement of a border edge of the sheet-like material to selected inner and outer stop positions when the sheet-like material is held at respective first and second ready positions for enabling the hole sets to be punched by the peg means at predetermined positions on the sheet-like material.

17. A hole punch as in claim 16 in which said edge stop means comprises means forming a ridge on the female plate to provide said outer stop position with the ridge extending parallel with and spaced outwardly from the die openings at a predetermined distance which defines a line of positions along which the hole sets can be accurately punched at said predetermined positions.

18. A hole punch for use by a person to manually punch holes through sheet-like material to produce hole sets which are appropriately sized and positioned to enable the sheet-like material to be mounted on a multi-ring binder, the hole punch comprising the combination of a male plate having a plurality of punch pegs, a female plate having a plurality of die openings sized commensurate with the punch pegs, pivot means for pivotally mounting the male and female plates for movement about a pivot axis between open and closed positions, with the punch pegs being spaced from the die openings when the plates are in said open positions for enabling insertion of the sheet-like material between the punch pegs and die openings, and with the punch pegs further penetrating at least partially into the die openings when the plates are moved toward said closed positions for causing the punch pegs to punch said hole sets through the inserted sheet-like material, and said female plate having at least one extension portion which projects in a direction from said pivot axis beyond the male plate to enable the person to releasably hold the sheet-like material against the extension portion during the operation of the hole punch, said male plate comprising first and second wings which extend outwardly in opposite directions from said pivot axis, a first group of the punch pegs carried by said first wing and a second group of the punch pegs carried by said second wing, and said first wing pivotal about said pivot means for moving said first group of punch pegs toward and away from a first group of the die openings while simultaneously causing the second wing to move respectively away from and toward a second group of said die openings.

19. A hole punch as in claim 18 in which at least two of said punch pegs have distal ends which project at different lengths from the male plate to minimize the amount of force required to cause the punch pegs to punch holes through the sheet-like material.

20. A hole punch as in claim 18 in which a plurality of said punch pegs are aligned along at least one cutting axis which overlies the die openings when the male and female plates are in said closed position, and said male plate pivoting relative to the female plate about an axis which extends substantially parallel with said cutting axis of the punch pegs, and at least certain ones of said punch pegs are each formed at their distal ends with crowns with each crown having a pair of diametrically opposed cutting edges that face toward and shear along said die openings during said insertion of the punch pegs into the die openings, the cutting edges being contoured with convex peaks which are oriented at a bias to said cutting axis for minimizing the amount of force required to cause the punch pegs to punch holes through the sheet-like material.

21. A hole punch as in claim 18 which includes yieldable means for applying a yieldable force against the sheet-like material in a direction to releasably hold the material in place against the die openings when the material is in a ready position between the punch pegs and die openings.

22. A hole punch as in claim 18 which includes yieldable means for applying a yieldable force against the sheet-like material in a direction to move the material away from the peg means after said withdrawal of the peg means from the die openings.

23. A hole punch as in claim 18 in which said male plate is formed with opposing side portions which diverge outwardly at angles from respective adjacent portions of the female plate when the male and female plates are moved to a neutral position at which said side portions are substantially equally spaced from the female plate.

24. A hole punch for use by a person to manually punch holes through sheet-like material to produce hole sets which are appropriately sized and positioned to enable the sheet-like material to be mounted on a multi-ring binder, the hole punch comprising the combination of a male plate having a plurality of punch pegs, a female plate having a plurality of die openings sized commensurate with the punch pegs, pivot means for pivotally mounting the male and female plates for movement about a pivot axis between open and closed positions, with the punch pegs being spaced from the die openings when the plates are in said open positions for enabling insertion of the sheet-like material between the punch pegs and die openings, and with the punch pegs further penetrating at least partially into the die openings when the plates are moved toward said closed positions for causing the punch pegs to punch said hole sets through the inserted sheet-like material, and said female plate having at least one extension portion which projects in a direction from said pivot axis beyond the male plate to enable the person to releasably hold the sheet-like material against the extension portion during the operation of the hole punch, said female plate comprising third and fourth wings which extend outwardly in opposite directions from said pivot axis, and first and second groups of die openings being carried on respective third and fourth wings of the female plate.

25. A hole punch for use by a person to manually punch holes through sheet-like material to produce hole sets which are appropriately sized and positioned to enable the sheet-like material to be mounted on a multi-ring binder, the hole punch comprising the combination of a male plate having a plurality of punch pegs, a female plate having a plurality of die openings sized commensurate with the punch pegs, pivot means for pivotally mounting the male and female plates for movement about a pivot axis between open and closed positions, with the punch pegs being spaced from the die openings when the plates are in said open positions for enabling insertion of the sheet-like material between the punch pegs and die openings, and with the punch pegs further penetrating at least partially into the die openings when the plates are moved toward said closed positions for causing the punch pegs to punch said hole sets through the inserted sheet-like material, and said female plate having at least one extension portion which projects in a direction from said pivot axis beyond the male plate to enable the person to releasably hold the sheet-like material against the extension portion during the operation of the hole punch, said hole punch for use with a mounting sheet for mounting the hole punch on said binder having an aperture defined by spaced-apart parallel side edges, at least some of said male and female plates defining support slots for receiving the side edges of the mounting sheet and allowing slidable movement of said hole punch relative to the mounting sheet for changing the positions at which hole sets can be punched through sheet-like material by said hole punch.

* * * * *